US008704753B2

(12) United States Patent
Miyazaki et al.

(10) Patent No.: US 8,704,753 B2
(45) Date of Patent: Apr. 22, 2014

(54) ELECTROPHORESIS DISPLAY DEVICE AND A METHOD FOR CONTROLLING THE DRIVING ELECTROPHORESIS DISPLAY ELEMENTS OF AN ELECTROPHORESIS DISPLAY DEVICE

(75) Inventors: Atsushi Miyazaki, Suwa (JP); Mitsutoshi Miyasaka, Suwa (JP)

(73) Assignee: Seiko Epson Corporation (JP)

( * ) Notice: Subject to any disclaimer, the term of this patent is extended or adjusted under 35 U.S.C. 154(b) by 1618 days.

(21) Appl. No.: 11/739,711

(22) Filed: Apr. 25, 2007

(65) Prior Publication Data

US 2007/0247417 A1 Oct. 25, 2007

(30) Foreign Application Priority Data

Apr. 25, 2006 (JP) ..... 2006-121195
Feb. 21, 2007 (JP) ..... 2007-041386

(51) Int. Cl.
*G09G 3/34* (2006.01)

(52) U.S. Cl.
CPC ..... *G09G 3/344* (2013.01)
USPC ..... 345/107

(58) Field of Classification Search
CPC ... G02F 1/167; G09G 3/344; G09G 2310/068
USPC ..... 345/107; 359/296
See application file for complete search history.

(56) References Cited

U.S. PATENT DOCUMENTS 6,987,503 B2 1/2006 Inoue
7,259,745 B2 8/2007 Hamaguchi
7,773,069 B2 8/2010 Miyasaka et al.
7,839,381 B2 * 11/2010 Zhou et al. ..... 345/107
8,085,241 B2 12/2011 Miyasaka et al.
2006/0132426 A1 * 6/2006 Johnson ..... 345/107
2007/0052648 A1 * 3/2007 Zhou et al. ..... 345/94
2007/0212022 A1 * 9/2007 Zhou et al. ..... 386/94
2012/0062619 A1 3/2012 Miyasaka et al.

FOREIGN PATENT DOCUMENTS

CN 1345026 4/2002
JP 2002-014654 1/2002
JP 2002-116733 4/2002
JP 2003-140199 5/2003
JP 2004-287425 10/2004
JP 2005-148711 6/2005
JP 2005-345624 12/2005
JP 2006-227053 8/2006
JP 2006-267982 10/2006

* cited by examiner

*Primary Examiner* — Rodney Amadiz
(74) *Attorney, Agent, or Firm* — Harness, Dickey & Pierce, P.L.C.

(57) ABSTRACT

An electrophoresis display device includes electrophoresis display elements, corresponding to pixels of a display unit, each having a structure where a dispersion medium containing electrophoresis particles is interposed between a common electrode and a pixel electrode, a driving unit that applies a voltage between the common electrode and the pixel electrodes and drives the electrophoresis display elements, and a control unit that controls the driving unit. An image rewrite period, during which a rewrite display operation is performed on the electrophoresis display elements, includes a reset period and an image signal introducing period. During the image signal introducing period, the electrophoresis display elements are driven with a first data input pulse and a second data input pulse.

20 Claims, 10 Drawing Sheets

ELECTROPHORESIS DISPLAY DEVICE AND A METHOD FOR CONTROLLING THE DRIVING ELECTROPHORESIS DISPLAY ELEMENTS OF AN ELECTROPHORESIS DISPLAY DEVICE

BACKGROUND

1. Technical Field

Several aspects of the present invention relate to an electrophoresis display device (or electrophoresis device) that includes a dispersion medium containing electrophoresis particles, to a method of driving an electrophoresis display device, and to an electronic apparatus.

2. Related Art

When an electric field is applied to a dispersion medium that is obtained by dispersing electrophoresis particles in a solution, a phenomenon (electrophoresis phenomenon) of the electrophoresis particles moving due to the Coulomb force is generated. Electrophoresis display devices using the electrophoresis phenomenon have been developed. Examples of the electrophoresis display devices are disclosed in JP-A-2002-116733, JP-A-2003-140199, or the like.

In the electrophoresis display device, in a state where charged electrophoresis particles are interposed between two electrodes, a predetermined voltage according to an image signal is applied between the two electrodes so as to cause the colored electrophoresis particles to move, thereby forming an image.

However, since all the electrophoresis particles cannot have the same behavior, even when the predetermined voltage is applied between the electrodes, there are electrophoresis particles that do not move to predetermined locations. Further, even when the electrophoresis particles move to the predetermined locations, the electrophoresis particles may precipitate or float due to the convection of a dispersion liquid. In this case, colors may not become clear, a residual image may be formed, or a variation in color or luminance may occur between pixels.

SUMMARY

An advantage of some aspects of the invention is that it provides an electrophoresis display device capable of improving image quality, a method of driving an electrophoresis display device, and an electronic apparatus.

According to a first aspect of the invention, an electrophoresis display device includes electrophoresis display elements, corresponding to pixels of a display unit, each having a structure where a dispersion medium containing electrophoresis particles is interposed between a common electrode and a pixel electrode, a driving unit that applies a voltage between the common electrode and the pixel electrodes and drives the electrophoresis display elements, and a control unit that controls the driving unit. An image rewrite period, during which a rewrite display operation is performed on the electrophoresis display elements, includes a reset period and an image signal introducing period. During the image signal introducing period, the electrophoresis display element is driven with a first data input pulse and a second data input pulse that is different from the first data input pulse.

Preferably, when a period during which a data write operation is performed once on all the pixels of the display unit is defined as a first frame period, the image signal introducing period includes a plurality of frame periods. Preferably, the first data input pulse is used during the first frame period that is an initial frame period among the plurality of frame periods, and the second data input pulse is used during frame periods other than the first frame period. Preferably, a pulse width of the second data input pulse is equal to or smaller than a pulse width of the first data input pulse, and the pulse intensity of the second data input pulse is equal to or weaker than the pulse intensity of the first data input pulse.

According to a second aspect of the invention, an electrophoresis display device includes electrophoresis display elements, corresponding to pixels of a display unit, each having a structure where a dispersion medium containing electrophoresis particles is interposed between a common electrode and a pixel electrode, a driving unit that applies a voltage between the common electrode and the pixel electrodes and drives the electrophoresis display elements, and a control unit that controls the driving unit. An image rewrite period, during which the control unit controls the driving unit so as to allow the driving unit to apply a voltage for performing an image rewrite operation between the common electrode and the pixel electrodes, includes a reset period and an image signal introducing period that is set after the reset period. The image signal introducing period includes a plurality of frame periods during which signals constituting a display image are individually supplied, and at least one different frame period during which a data input pulse, which has a pulse width and/or a pulse intensity (at least one of the pulse width and the pulse intensity) different from a pulse width and a pulse intensity of a data input pulse during a first frame period, is applied to the electrophoresis display elements.

According to this structure, the plurality of frame periods are set during the image signal introducing period after the reset period, and the voltage pulse is applied a plurality of times to each of the selected pixels. Therefore, the electrophoresis particles (hereinafter, simply referred to as particles), which do not move to the predetermined locations (pixel electrode or common electrode) during the first frame period or further move from the predetermined locations due to the convection of the dispersion medium can move to the predetermined locations by applying the data input pulse during the frame periods subsequent to the first frame period.

Further, if the pulse widths and/or pulse intensities of the data input pulses during the first frame period and the frame periods subsequent to the first frame period are changed, the data input pulses having the minimum period and intensity can be supplied for the minimum time during the frame periods subsequent to the first frame period in accordance with the distribution state of the particles that do not move to the predetermined locations during the first frame period. Accordingly, the image quality can be improved with the minimum power consumption.

Further, in order to perform an image rewrite operation with a plurality of frames, it is possible to achieve an effect of the entire screen being gradually varied, such as a so-called fade-in effect or fade-out effect.

Preferably, a total sum of pulse widths of data input pulses applied to each pixel during a portion of the plurality of frame periods is the minimum amount of application time that is required to move the electrophoresis particles to predetermined locations so as to display a predetermined image. According to this structure, since the electrophoresis particles can move to the predetermined locations by applying the pulse a plurality of times, it is possible to reduce the convection of the dispersion occurring when the electrophoresis particles move. Therefore, it is possible to reduce irregularities in the distribution of the electrophoresis particles that occur due to the convection of the dispersion medium after the electrophoresis particles move to the predetermined locations.

Preferably, a pulse width of the data input pulse during the first frame period is the minimum amount of application time that is required to move the electrophoresis particles to predetermined locations so as to display a predetermined image. According to this structure, since it is possible to move the electrophoresis particles during the first frame period, a response time required at the time of display can be shortened.

Preferably, the electrophoresis display device according to the second aspect of the invention further includes storage capacitors, each of which has one electrode connected to the common electrode and the other electrode connected to a corresponding pixel electrode. According to this structure, the difference potential between the pixel electrode and the common electrode can be further stabilized, and the voltage applied to the electrophoresis display element can be further improved.

Preferably, pulse widths of the data input pulses are gradually decreased for each frame period. Preferably, when it is assumed that n is a natural number, a pulse width of the data input pulse during a (n+1)-th frame period is equal to or smaller than a pulse width of the data input pulse during an n-th frame period. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

Preferably, the pulse intensities of the data input pulses are gradually decreased during the frame periods. Preferably, when it is assumed that n is a natural number, the pulse intensity of the data input pulse during a (n+1)-th frame period is equal to or weaker than the pulse intensity of the data input pulse during an n-th frame period. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

Preferably, during the reset period, a plurality of reset pulses are applied to the common electrode, and a pulse width of at least one reset pulse among the plurality of reset pulses is different from a pulse width of a first reset pulse. Preferably, pulse widths of the reset pulses are gradually decreased. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

Preferably, during the reset period, a plurality of reset pulses are applied to the common electrode, and the pulse intensity of at least one reset pulse among the plurality of reset pulses is different from the pulse intensity of a first reset pulse. Preferably, pulse intensities of the reset pulses are gradually decreased. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

According to a third aspect of the invention, an electronic apparatus includes the above-described electrophoresis display device. According to this structure, since the electronic apparatus includes the above-described electrophoresis display device, it is possible to obtain an electronic apparatus in which image quality of a display unit is excellent. In this case, the 'electronic apparatus' means a general electronic apparatus that has a predetermined function, and its structure is not limited to a specific structure. Examples of the electronic apparatus include an electronic paper, an electronic book, an IC card, a PDA, an electronic note, or the like.

According to a fourth aspect of the invention, there is provided a method of driving an electrophoresis display device that includes electrophoresis display elements, corresponding to pixels of a display unit, each having a structure where a dispersion medium containing electrophoresis particles is interposed between a common electrode and a pixel electrode. The method includes applying a reset voltage to the electrophoresis display elements and moving the electrophoresis particles in the dispersion medium to predetermined locations so as to erase an image on a display screen, and supplying a plurality of data input pulses to each of selected pixels after a reset operation. At least one data input pulse among the plurality of data input pulses has a pulse width and/or a pulse intensity different from a pulse width and a pulse intensity of a first data input pulse.

According to this structure, after the reset operation, the voltage pulses are applied a plurality of times to each of the selected pixels. For example, the electrophoresis particles (hereinafter, simply referred to as particles), which do not move to the predetermined locations (pixel electrode or common electrode) by means of one-time application of a data input pulse or further move from the predetermined locations due to the convection of the dispersion medium, can move to the predetermined locations by means of application of the data input pulse starting from the second data input pulse application.

Further, if the pulse widths and/or pulse intensities of the first data input pulse and the data input pulses subsequent to the first data input pulse are changed, the data input pulses having the minimum period and intensity and subsequent to the first data input pulse can be supplied in accordance with the distribution state of the electrophoresis particles that do not move to the predetermined locations by the application of the first input pulse. Therefore, the image quality can be improved with the minimum power consumption.

Preferably, pulse widths of the data input pulses are gradually decreased. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

Preferably, pulse intensities of the data input pulses are gradually decreased. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

Preferably, the reset voltage is applied a plurality of times, and a pulse width of at least one reset pulse is different from a pulse width of a first reset pulse. Preferably, pulse widths of the reset pulses are gradually decreased. According to this structure, an influence due to the convection of the dispersion medium can be gradually decreased as the electrophoresis particles move, and thus the distance by which the electrophoresis particles move again can be gradually decreased.

Accordingly, the image quality can be improved with the minimum power consumption.

Preferably, the reset voltage is applied a plurality of times, and a pulse intensity of at least one reset pulse is different from a pulse intensity of a first reset pulse. Preferably, pulse intensities of the reset pulses are gradually decreased. According to this structure, an influence due to the convection of the dispersion medium can be gradually decreased as the electrophoresis particles move, and thus the distance by which the electrophoresis particles move again can be gradually decreased. Accordingly, the image quality can be improved with the minimum power consumption.

According to a fifth aspect of the invention, an electrophoresis display device includes electrophoresis display elements, corresponding to pixels of a display unit, each having a structure where a dispersion medium containing electrophoresis particles is interposed between a common electrode and a pixel electrode, a driving unit that applies a voltage between the common electrode and the pixel electrodes and drives the electrophoresis display elements, and a control unit that controls the driving unit. An image rewrite period, during which the control unit controls the driving unit so as to allow the driving unit to apply a voltage for performing an image rewrite operation between the common electrode and the pixel electrodes, includes a reset period and an image signal introducing period that is set after the reset period, and during the reset period and/or image signal introducing period, a predetermined voltage pulse is applied to selected pixels from among the pixels so as to move the electrophoresis particles to substantially predetermined locations, at least one additional voltage pulse, which has a pulse width and/or a pulse intensity different from a pulse width and a pulse intensity of the predetermined voltage pulse, is continuously applied to the selected pixels, such that locations of the electrophoresis particles are minutely adjusted.

According to this structure, a voltage pulse is applied a plurality of times to each of the selected pixels. For example, the electrophoresis particles, which do not move to the predetermined locations (pixel electrode or common electrode) during the first frame period or further move from the predetermined locations due to the convection of the dispersion medium, can move to the predetermined locations by applying the data input pulse during the frame periods subsequent to the first frame period.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the preferred embodiments of the invention will be described with reference to the accompanying drawings.

First Embodiment

Figure 1:
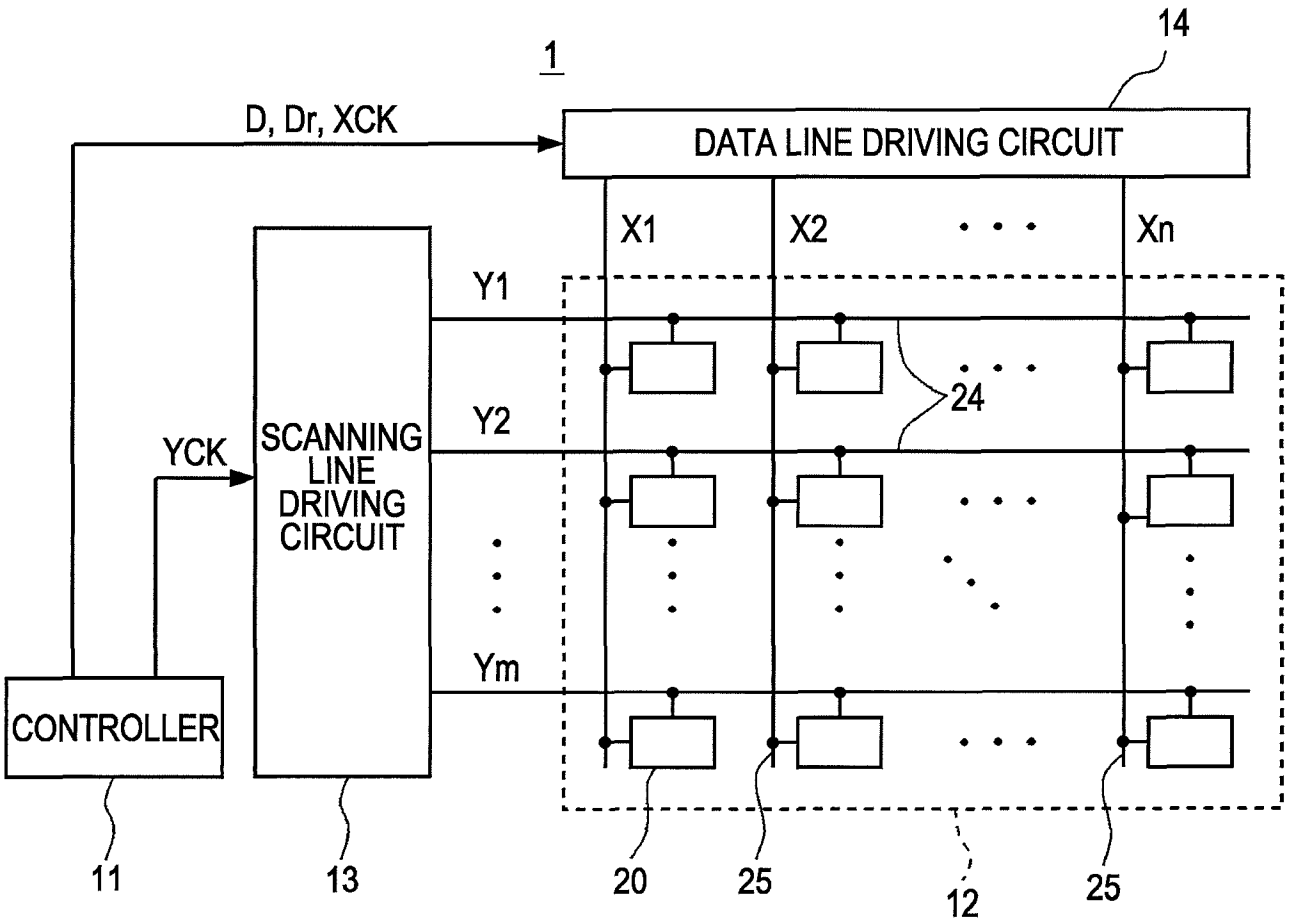
FIG. 1 is a block diagram schematically illustrating a circuit structure of an electrophoresis display device according to a first embodiment of the invention.

FIG. 1 is a block diagram schematically illustrating a circuit structure of an electrophoresis display device according to a first embodiment of the invention. An electrophoresis display device 1 according to the first embodiment shown in FIG. 1 includes a controller 11, a display unit 12, a scanning line driving circuit 13, and a data line driving circuit 14.

The controller 11 controls the scanning line driving circuit 13 and the data line driving circuit 14, and includes an image signal processing circuit or a timing generator that is not shown in the drawings. The controller 11 generates an image signal (image data) indicating an image displayed on the display unit 12, reset data for performing a reset operation at the time of rewriting an image, and various signals (clock signal or the like), and outputs them to the scanning line driving circuit 13 or the data line driving circuit 14.

The display unit 12 includes a plurality of data lines 25 that are disposed substantially parallel to an X direction, a plurality of scanning lines 24 that are disposed substantially parallel to a Y direction, and pixel circuits 20 that are disposed so as to correspond to intersections of the data lines 25 and the scanning lines 24. The display unit 12 displays an image using electrophoresis display elements that are included in the individual pixel circuits 20.

The scanning line driving circuit 13 is connected to the individual scanning lines 24 of the display unit 12. The scanning line driving circuit 13 selects scanning lines from among the scanning lines 24, and supplies predetermined scanning signals Y1, Y2, . . . , and Ym to the selected scanning lines 24. The scanning signals Y1, Y2, . . . , and Ym become signals whose active periods (H level periods) are sequentially shifted, and are output to the scanning lines 24, such that the pixel circuits 20 connected to the scanning lines 24 are sequentially turned on.

The data line driving circuit 14 is connected to the data lines 25 of the display unit 12. The data line driving circuit 14 supplies data signals X1, X2, . . . , and Xn to the pixel circuits 20 that are selected by the scanning line driving circuit 13.

Further, the controller 11 corresponds to a 'control unit' according to an aspect of the invention, and the scanning line driving circuit 13 and the data line driving circuit 14 correspond to a 'driving unit' according to an aspect of the invention.

Figure 2:
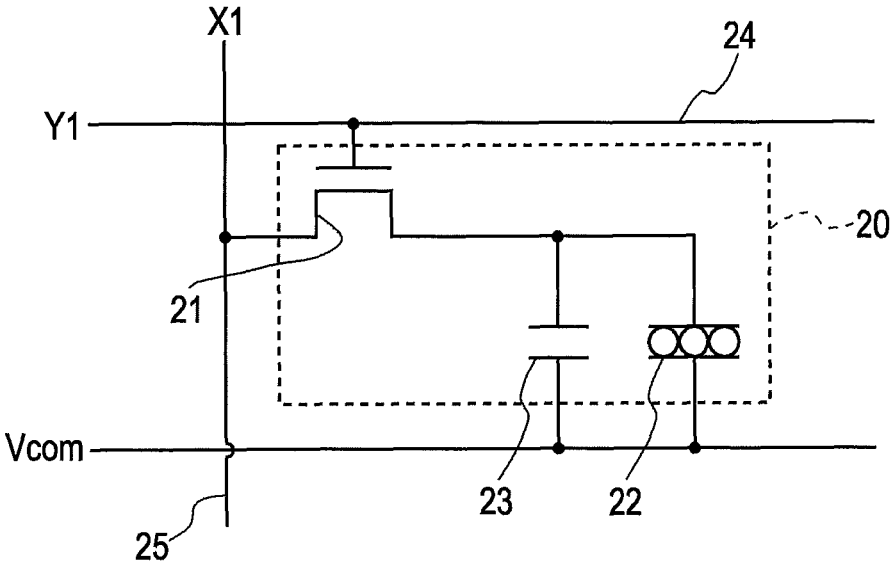
FIG. 2 is a circuit diagram illustrating a structure of each pixel circuit.

FIG. 2 is a circuit diagram illustrating a structure of each pixel circuit 20. Each pixel circuit 20 shown in FIG. 2 includes a switching transistor 21, an electrophoresis display element 22, and a storage capacitor 23. The transistor 21 is composed of an n-channel transistor, and includes a gate that is connected to the scanning line 24, a source that is connected to the data line 25, and a drain that is connected to a pixel electrode of the electrophoresis display element 22. The electrophoresis display element 22 is constructed by interposing a dispersion system 35 between the pixel electrode 33 provided for each pixel and a common electrode 34 used in common by the pixels. The storage capacitor 23 is connected in parallel to the electrophoresis display element 22. Specifically, the storage capacitor 23 has one electrode connected to a drain of a switching transistor and the other electrode connected to the common electrode 34. As such, since the storage capacitor 23 is connected in parallel to the electrophoresis display element 22, even when a voltage applied to the electrophoresis display element 22 is changed, it is possible to compensate for charge by using the storage capacitor 23. Therefore, the potential difference between the pixel electrode and the common electrode can be stabilized, and the voltage applied to the electrophoresis display element 22 can be further stabilized.

Figure 3:
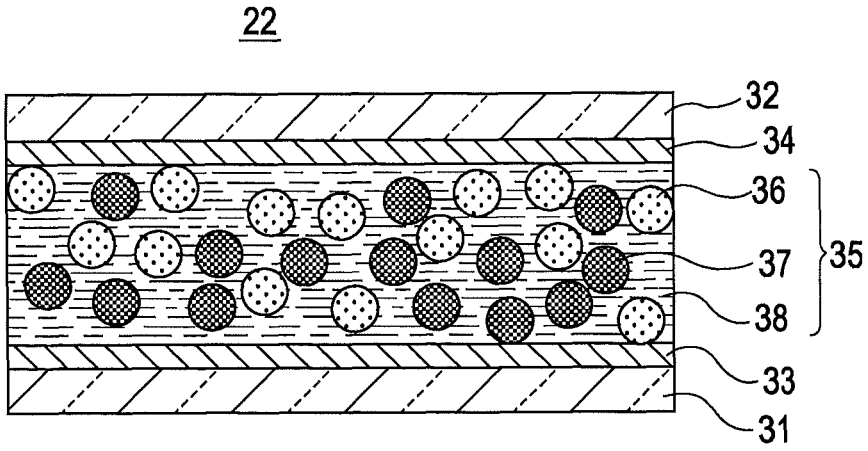
FIG. 3 is a cross-sectional view schematically illustrating an example of a structure of an electrophoresis display element.

FIG. 3 is a cross-sectional view schematically illustrating an example of a structure of the electrophoresis display element. As shown in FIG. 3, the electrophoresis display element 22 according to this embodiment is constructed by interposing the dispersion system 35 between the pixel electrode 33 formed on a substrate 31 made of glass or resin and the common electrode 34 formed on a light transmitting substrate 32 made of glass or resin. The pixel electrode 33 is not necessarily a transparent electrode. However, the pixel electrode 33 is made of, for example, an indium tin oxide (ITO) film. The common electrode 34 uses a light transmitting transparent electrode, and is made of, for example, the ITO film. The dispersion system 35 has a structure in which electrophoresis particles 36 and 37 are contained in a dispersion medium (dispersion liquid) 38. In this embodiment, it is assumed that the electrophoresis particles 36 are white particles that are each charged with a negative polarity, and the electrophoresis particles 37 are black particles that are each charged with a positive polarity. Further, a white pigment, for example, titanium dioxide is used as the white particles, and a black pigment, for example, carbon black is used as the black particles.

Next, a display principle of the electrophoresis display device 1 according to this embodiment will be described.

In the electrophoresis display device 1 according to this embodiment, the voltage applied between the pixel electrode 33 and the common electrode 34 is controlled so as to change a spatial arrangement of the electrophoresis particles 36 and 37. That is, a distribution state of electrophoresis particles in each pixel is changed, thereby displaying an image. Specifically, if a negative voltage is applied to the pixel electrode 33 from the common electrode 34, the white electrophoresis particles 36 that are charged with a negative polarity move toward the common electrode 34 at the display surface side due to the Coulomb force, and the black electrophoresis particles 37 that are charged with a positive polarity move toward the pixel electrode 33. As a result, a white color is displayed on the display surface. Meanwhile, when a positive voltage is applied to the pixel electrode 33 from the common electrode 34, the white electrophoresis particles 37 that are charged with a positive polarity move toward the common electrode 34 at the display surface side, and the white electrophoresis particles 36 that are charged with a negative polarity move toward the pixel electrode 33. Therefore, a black color is displayed on the display surface.

Specific gravity of each of the electrophoresis particles 36 and 37 is set to be substantially equal to specific gravity of the dispersion medium 38. As a result, even after application of an external electric field is stopped with respect to the electrophoresis display element 22 (dispersion system 35), the electrophoresis particles 36 and 37 can be retained at the predetermined locations in the dispersion medium 38 for a long period.

The speed at which the electrophoresis particles 36 and 37 move is determined according to the intensity of an electric filed (application voltage). Further, the movement distance of the electrophoresis particles 36 and 37 is determined according to the application voltage and the application time. Accordingly, if the application voltage and the application time are adjusted, the electrophoresis particles 36 and 37 can move between the two electrodes.

Meanwhile, if particle characteristics of the electrophoresis particles 36 and 37, such as electric characteristics (for example, charge amount) or mechanical characteristics (for example, particle diameter and weight), are constant in all the electrophoresis particles, all the electrophoresis particles show the same behavior, and move at the same speed. However, a variation may occur in the particle characteristics due to a restriction in material or manufacturing methods of the electrophoresis particles 36 and 37.

In this case, even though a predetermined voltage is applied for a predetermined time according to the distance between electrodes, all the electrophoresis particles may not show the same behavior, and thus may not move by the distance between the pixel electrode 33 and the common electrode 34. Further, even after the electrophoresis particles 36 and 37 move to the predetermined locations, the electrophoresis particles 36 and 37 may further move from the predetermined locations due to the convection of the dispersion medium 38 occurring when the electrophoresis particles 36 and 37 move. At this time, a variation occurs in a spatial distribution state of the electrophoresis particles 36 and 37. As a result, a color may not become clear, a residual image may be formed, and a variation in color or luminance between pixels may occur.

Accordingly, in this embodiment, after a predetermined voltage is applied to the electrophoresis particles 36 and 37 for the minimum time required to move the electrophoresis particles 36 and 37 between the electrodes by a predetermined distance, the predetermined voltage is applied between the electrodes for a time shorter than the minimum time such that the particles, which do not move to the predetermined locations or further move from the predetermined locations, can move to the predetermined locations again. In this way, image quality is improved.

Next, a method of driving each electrophoresis display element in the electrophoresis display device 1 will be described.

Figure 4:
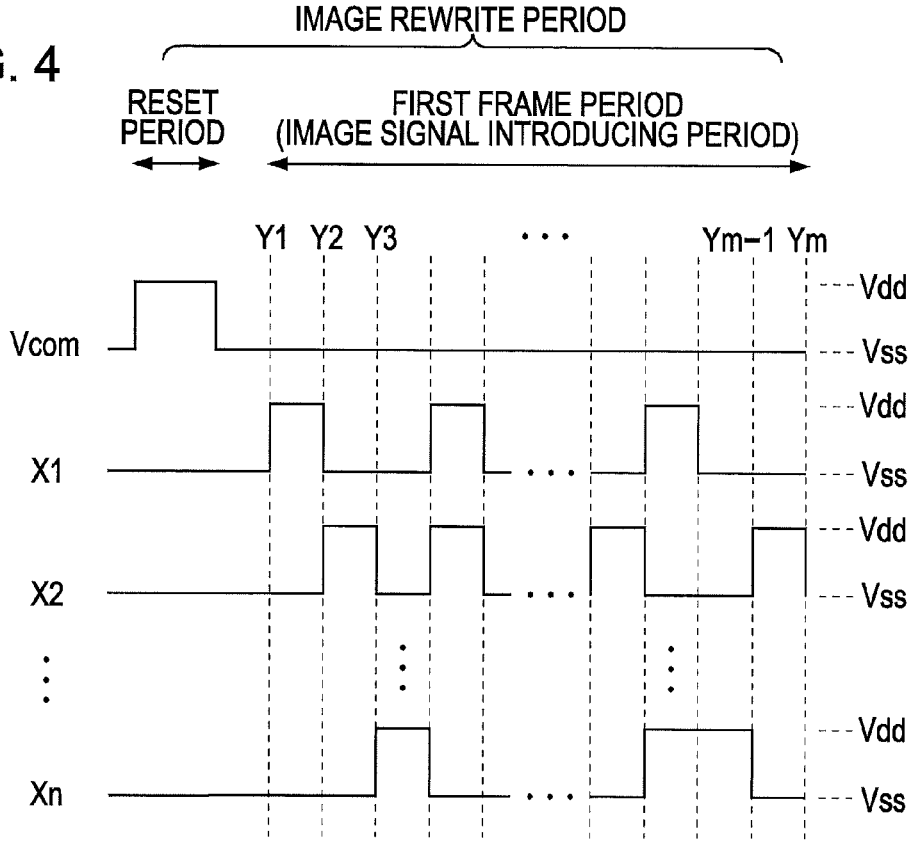
FIG. 4 is a signal waveform diagram illustrating a basic driving method used during a unit image write period of the electrophoresis display device according to the first embodiment of the invention.

FIG. 4 is a signal waveform diagram illustrating a basic driving method used during a unit image rewrite period of the electrophoresis display device 1 according to this embodiment.

In this case, the image rewrite period is a period during which the controller 11 controls the scanning line driving circuit 13 and the data line driving circuit 14 such that a voltage for performing an image rewrite operation is applied between the common electrode 34 and the pixel electrode 33. In the electrophoresis display device 1 according to this embodiment, a reset period and an image signal introducing period are included in the image rewrite period.

Further, the image signal introducing period is a period during which image data (image signal) is introduced, and includes a plurality of frame periods, which will be described below. However, for simplification of description, a waveform of a first frame period is shown in FIG. 4. The reset period is a period during which an image is temporarily erased, and which is set before the image signal introducing period. During the reset period, the image is temporarily erased, and the locations of the electrophoresis particles are set again, which reduces irregularities in a newly formed image.

First, if the reset period starts, the image signal processing circuit and the timing generator of the controller 11 supply reset data Dr and clock signals XCK and YCK to the scanning line driving circuit 13 and the data line driving circuit 14, as shown in FIG. 1. The scanning line driving circuit 13 supplies the scanning signals Y1, Y2, . . . , and Ym to the individual scanning lines 24 in accordance with the clock signal YCK. Further, on the basis of the reset data Dr and the clock signal XCK, the data line driving circuit 14 supplies the data signals X1, X2, . . . , and Xn to the individual data lines 25 so as to synchronize with the scanning signals Y1, Y2, . . . , and Ym.

As shown in FIG. 4, in this example, a low power supply potential Vss (for example, 0 V) is applied to the pixel electrodes 33 of all the pixels through the individual data lines 25. Then, a high power supply potential Vdd (for example, +15 V) is applied to the common electrode 34 having the potential (common potential) Vcom for a predetermined time. In this example, since the difference potential (reset voltage) between the lower power supply potential and the high power supply potential is applied to the electrophoresis display element 22, the white electrophoresis particles 36 that are charged with a negative polarity move to the common electrode 34. As a result, a display screen is reset to white display.

Next, a write operation during the image signal introducing period will be described. If the first frame period of the image signal introducing period starts, the controller 11 starts the write operation. As shown in FIG. 1, the image signal processing circuit and the timing generator of the controller 11 supply the image data D (image signal) and the clock signals XCK and YCK to the scanning line driving circuit 13 and the data line driving circuit 14. The scanning line driving circuit 13 supplies the scanning signals Y1, Y2, . . . , and Ym to the individual scanning lines 24 in accordance with the clock signal YCK. Further, on the basis of the image data D and the clock signal XCK, the data line driving circuit 14 supplies the data signals X1, X2, . . . , and Xn to the individual data lines 25 so as to synchronize with the scanning signals Y1, Y2, . . . , and Ym.

As shown in FIG. 4, in this example, the low power supply potential Vss is applied as the common potential Vcom, and a potential according to contents of a display image is applied to a pixel electrode 33 of each pixel through a corresponding data line 25. As a result, a predetermined image is displayed on a display screen. In addition, the same operation as performed in the first frame period is performed during frame periods subsequent to the first frame period.

In this embodiment, during a plurality of frame periods that are included in the unit image rewrite period, the same image data is supplied. That is, image data supplied during the first frame period and image data supplied during frame periods subsequent to the first frame period are data that constitute the same image. However, during the first frame period and the frame periods subsequent to the first frame period, pulse widths of data signals are gradually decreased for each frame period. For example, a pulse width of the data signal X1 of the second frame period applied to the data line 25 is narrower than a pulse width of the data signal X1 of the first frame period applied to the data line 25.

Hereinafter, the operation of the electrophoresis display device 1 according to this embodiment will be described by considering one display unit. A pixel Pij that corresponds to an i-th row (i-th scanning line) and a j-th column (j-th data line) will be exemplified.

Figure 5:
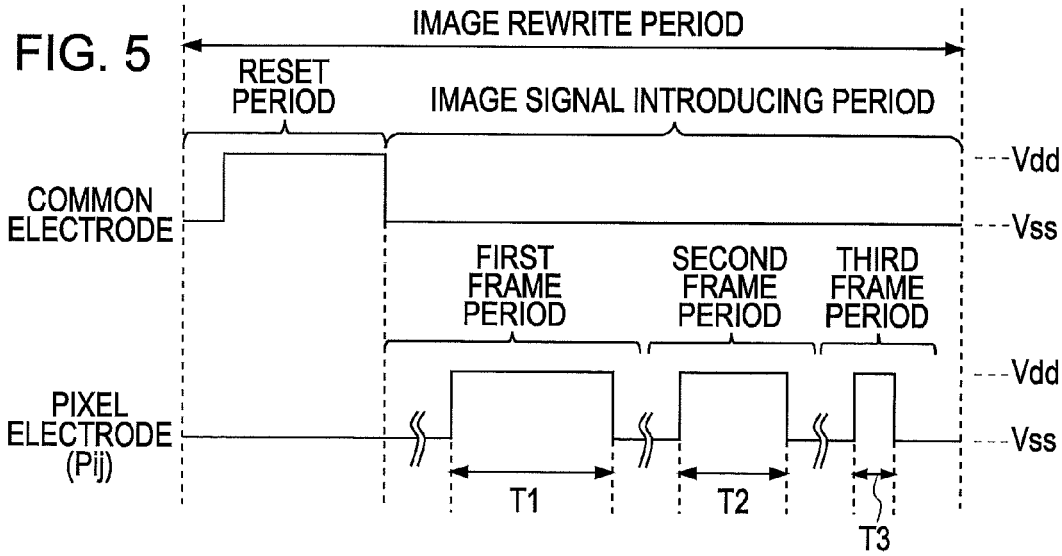
FIG. 5 is a signal waveform diagram illustrating the operation of the electrophoresis display device according to the first embodiment of the invention by considering one pixel.

FIG. 5 is a signal waveform diagram illustrating the operation of the electrophoresis display device 1 according to the first embodiment by considering one pixel (unit pixel).

Figure 6A:
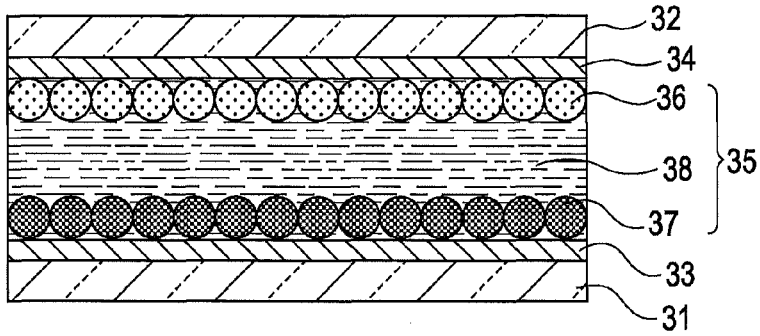
FIGS. 6A to 6C are diagrams illustrating the operation of electrophoresis particles by considering one pixel.

A case will be described in which the pixel Pij is allowed to perform black display. As described above, after the reset operation is performed (see FIG. 6A), during the first frame, first, a scanning signal Yi (voltage G1), which makes a transistor 21 be turned on for a predetermined period (H level period), is supplied to the i-th scanning line 24, and a pixel circuit 20 of the pixel Pij is turned on.

Next, a voltage pulse (data input pulse), which is output from the controller 11 through the scanning line driving circuit 13 and has a pulse width T1 and a pulse intensity, that is, a potential Vdd (for example, 15 V), is applied to a pixel electrode 33 through the data line 25. Meanwhile, a constant potential Vss (for example, 0 V) is applied to the common electrode 34. Accordingly, a difference potential (Vdd−Vss) between the potential Vdd and the constant potential Vss is applied to the dispersion system 35 that is interposed between the pixel electrode 33 and the common electrode 34 during a period T1. In this case, the period T1 is preferably the minimum amount of application time that is required to move the black electrophoresis particles 37 from the pixel electrode 33 to the common electrode 34, when the potential Vdd is applied.

Figure 6B:
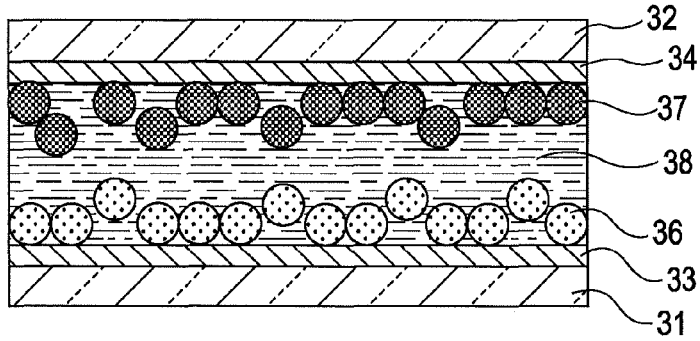

As shown in FIG. 6B, when a voltage is applied to the dispersion system 35, most of black electrophoresis particles 37 move to the common electrode 34 during the period T1, and most of white electrophoresis particles 36 move to the pixel electrode 33 during the period T1. In this stage, a predetermined image is viewed on the entirety of the display surface.

In this stage, as shown in FIG. 6B, all the electrophoresis particles 36 and 37 do not move to the predetermined locations, and the electrophoresis particles 36 and 37, which have moved to the predetermined locations, may precipitate or float due to the convection that is caused by the movement of the electrophoresis particles 36 and 37. As a result, at the time of viewing the display surface, the resolution of the image may be lowered.

Figure 6C:
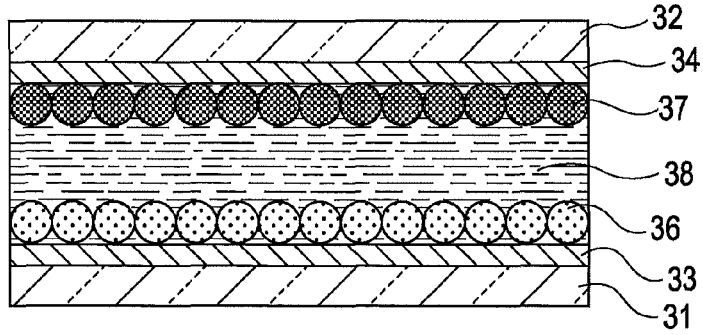

Accordingly, during the frame periods subsequent to the first frame period, a voltage pulse, which has the same pulse intensity as the voltage pulse applied during the first frame period, but has a pulse width (pulse application time) narrower than the pulse width T1 of the voltage pulse applied during the first frame period, is supplied. In this embodiment, voltage pulses whose pulse widths are gradually decreased are applied, that is, a voltage pulse having a pulse width T2 (T2<T1) is applied during the second frame period and a voltage pulse having a pulse width T3 (T3<T2) is applied during a third frame period. Then, as shown in FIG. 6C, since the voltage is applied to the electrophoresis display element 22 again, the electrophoresis particles that do not move to the predetermined locations during the first frame or the electrophoresis particles that further move from the predetermined locations due to the convection occurring in the dispersion medium 38 during the first frame move to the predetermined locations. Further, since pulse widths of voltage pulses that are applied to pixels during the frame periods are gradually decreased, almost all the electrophoresis particles can move to the predetermined locations without an excessive voltage being applied to the electrophoresis display element 22.

In this case, a pulse width of a voltage pulse that is applied to the pixel electrode 33 is not limited to a specific pulse width. However, the pulse width is preferable in a range of 1 to 700 msec, and is more preferable in a range of 10 to 500 msec. For example, it is assumed that a pulse width T1 of the first frame period is 200 msec, a pulse width T2 of the second frame period is 100 msec, and a pulse width T3 of the third frame period (final frame period) is 10 msec.

In this embodiment, when white display is realized in pixels, the white display is performed at the time of the reset operation. Therefore, the data signal is set to have the same potential as the potential Vcom (in the above-described example, 0 V) of the common electrode, and thus the white display is maintained at the time of the reset operation, thereby realizing the white display on the display screen.

In this embodiment, during the image signal introducing period, data input pulses whose pulse widths are gradually decreased are output to the dispersion system 35 interposed between the pixel electrode 33 and the common electrode 34 for each frame period. Therefore, it is possible to move almost all the electrophoresis particles to the predetermined locations (pixel electrode 33 or common electrode 34) without an excessive voltage being applied to the electrophoresis display element 22. Accordingly, the electrophoresis display element can be prevented from being chemically varied or deteriorated due to excessive heat, and image quality can be improved with minimum power consumption. In this embodiment, since the electrophoresis particles 36 and 37 are controlled by the pulse width, it is possible to use a power supply that cannot change a voltage in a multistage.

In the above-described example, the number of frame periods is three, but the invention is not limited thereto. That is, the number of frame periods may be two, or three or more. Preferably, the number of frame periods is in a range of 3 to 10. In the above-described example, the pulse widths of the data input pulses are decreased stepwise in the order of the first frame period, the second frame period, and the third frame period. However, during the plurality of frame periods, the data input pulses having the same pulse width may be applied. For example, the relation T1>T2=T3 may be set.

In the above-described example, the electrophoresis particles 36 and 37 move to almost exactly the predetermined locations (pixel electrode 33 or common electrode 34) during the first frame period, and minute adjustment is performed during the frame periods subsequent to the first frame period. However, the invention is not limited thereto. For example, the electrophoresis particles 36 and 37 may move to almost exactly the predetermined locations during the first and second frame periods, and the minute adjustment may be performed during the frame periods subsequent to the second frame period.

Second Embodiment

In the first embodiment, during the image signal introducing period, the data input pulses whose pulse widths are gradually decreased for each frame period are applied to the dispersion system 35 that is interposed between the pixel electrode 33 and the common electrode 34, and the electrophoresis particles 36 and 37 that do not move to the predetermined locations during the first frame period, move to the predetermined locations, thereby improving image quality. In the second embodiment, instead of the pulse width, the pulse intensity is changed so as to improve image quality.

Figure 7:
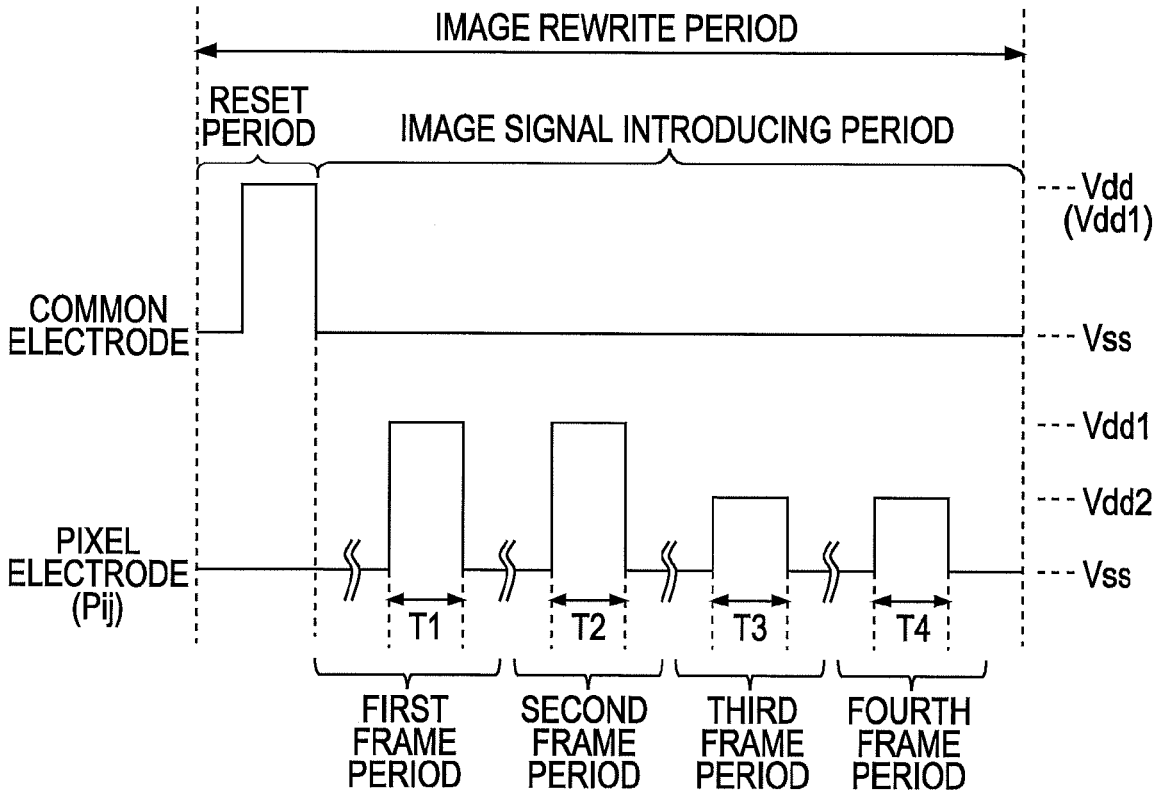
FIG. 7 is a signal waveform diagram illustrating the operation of an electrophoresis display device according to a second embodiment of the invention by considering one pixel.

FIG. 7 is a waveform diagram illustrating the operation of an electrophoresis display device 1 according to a second embodiment in consideration of one pixel.

In the second embodiment, the electrophoresis display device according to the second embodiment is driven in the same method as the electrophoresis display device according to the first embodiment, except that instead of the pulse width of the data input pulse, the pulse intensity thereof is changed.

As shown in FIG. 7, in this embodiment, the image signal introducing period includes four frame periods, and pulse widths of data input pulses supplied during the frame periods are the same, while the pulse intensities thereof (supply voltages) are different from one another. In this embodiment, pulse intensities H1 and H2 during the first frame period and the second frame period are Vdd1 (which is the same value as the potential Vdd of the common electrode, for example, 15 [V]), and the pulse intensities H3 and H4 during the third frame period and the fourth frame period are Vdd2 (for example, 6 [V]). The Vdd1 is a potential that is larger than the Vdd2 (Vdd1>Vdd2). During the first frame period and the second frame period, and the third frame period and the fourth frame period, the pulse intensity of the pulse is decreased with passage of the time.

Figure 8A:
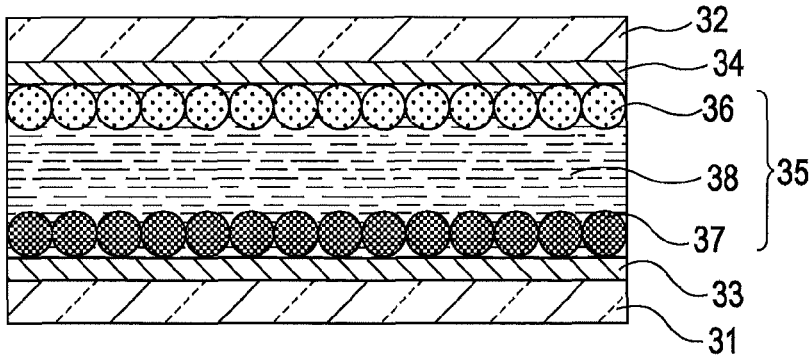
FIGS. 8A to 8D are diagrams illustrating the operation of electrophoresis particles by considering one pixel.
Figure 8B:
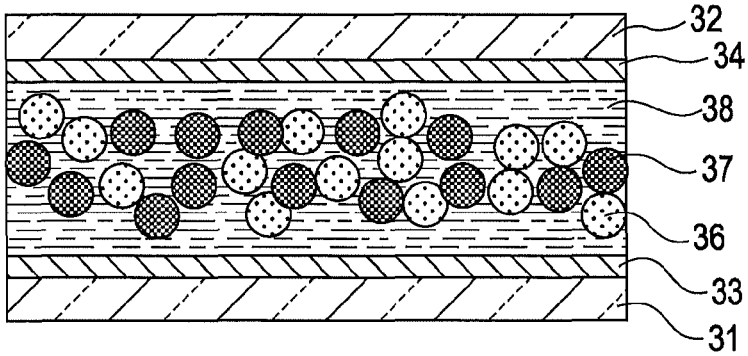
Figure 8C:
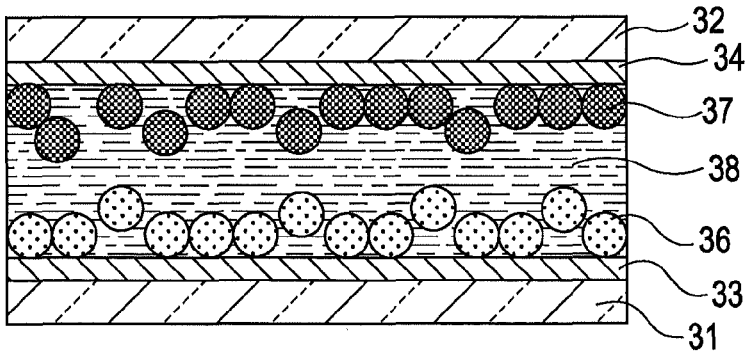
Figure 8D:
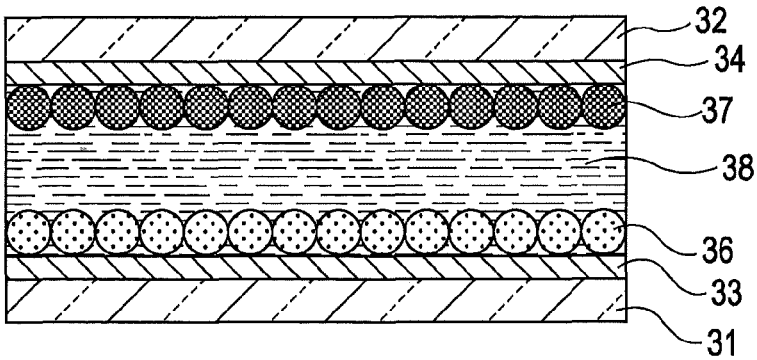

FIGS. 8A to 8D are diagrams illustrating the operation of electrophoresis particles 36 and 37 in consideration of one pixel. As shown in FIG. 8A, when a reset operation is completed, the white electrophoresis particles 36 move to the side of a common electrode 34, thereby realizing white display. Then, if the data input pulse having the pulse intensity H1 (that is, potential Vdd1) is applied during the first frame period, the electrophoresis particles 36 and 37 start to move to the sides of the pixel electrode 33 and the common electrode 34, respectively, as shown in FIG. 8B. Then, if the data input pulse having the pulse intensity H2 (that is, potential Vdd1) is applied during the second frame period, almost all the white electrophoresis particles 36 start to move to the side of the pixel electrode 33, and almost all the black electrophoresis particles 37 move to the side of the common electrode 34, as shown in FIG. 8C. If the data input pulses having the pulse intensities H2 and H3 (that is, potential Vdd2) are applied during the third frame period and the fourth frame period, the electrophoresis particles 36 and 37, which do not move to the predetermined locations until the second frame period or further move from the predetermined locations due to the convection of the dispersion medium 38 after the electrophoresis particles 36 and 37 move to the predetermined locations, can move to the predetermined locations, as shown in FIG. 8D.

In this embodiment, during the image signal introducing period, data input pulses whose pulse intensities are gradually decreased are output to the dispersion system 35 interposed between the pixel electrode 33 and the common electrode 34 for each frame period. Therefore, it is possible to move almost all the electrophoresis particles to the predetermined locations without an excessive voltage being applied to the electrophoresis display element 22. Accordingly, the electrophoresis display element can be prevented from being chemically varied or deteriorated due to excessive heat, and image quality can be improved with minimum power consumption.

In the above-described example, the number of frame periods is four, but similar to the first embodiment, the number of frame periods may be two or more. Preferably, the number of frame periods is in a range of 3 to 10. In the above-described example, the pulse intensities follow the relation of H1=H2>H3=H4, but the invention is not limited thereto. For example, the pulse intensities may be decreased according to the relation of H1>H2>H3>H4 during the individual frame periods.

Third Embodiment

In the first embodiment, the image quality is improved by changing the pulse width of the data input pulse while, in the second embodiment, the image quality is improved by changing the pulse intensity of the data input pulse. In the third embodiment, both the pulse width and the pulse intensity of the data input pulse are changed.

Figure 9:
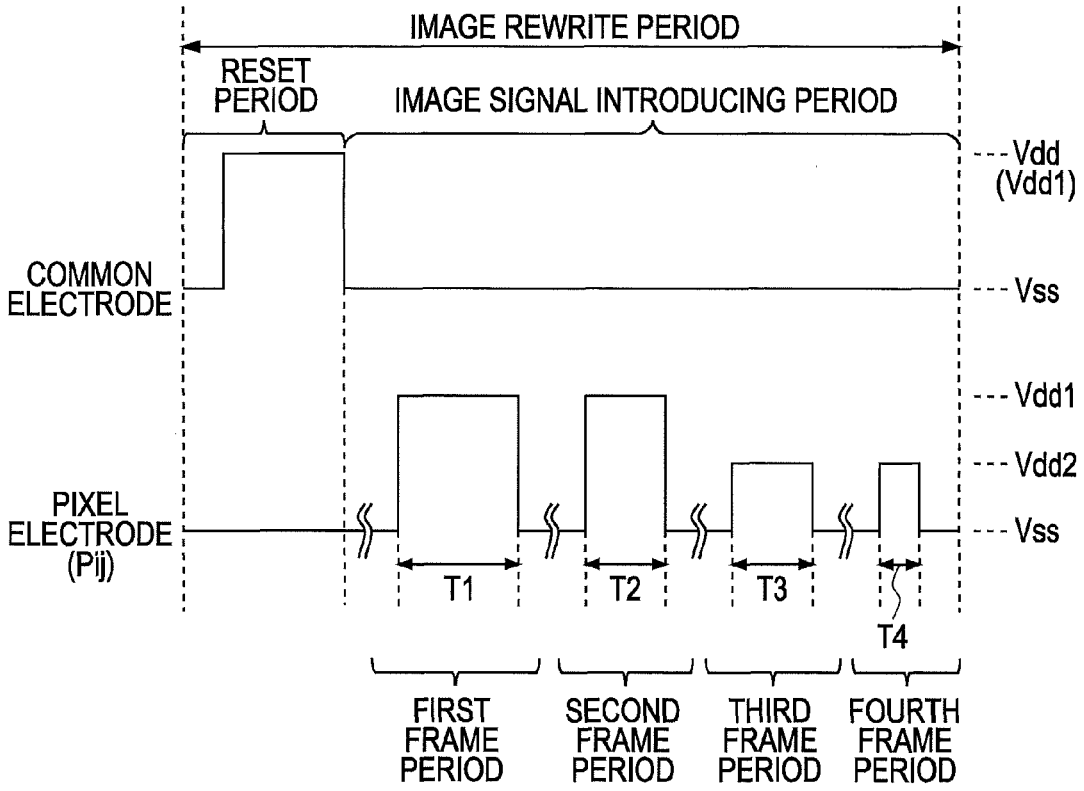
FIG. 9 is a signal waveform diagram illustrating the operation of an electrophoresis display device according to a third embodiment of the invention by considering one pixel.

FIG. 9 is a waveform diagram illustrating the operation of an electrophoresis display device 1 according to a third embodiment in consideration of one pixel. As shown in FIG. 9, in the third embodiment, the image signal introducing period includes four frame periods. A data input pulse that has the pulse intensity Vdd1 and the pulse width T1 is supplied during a first frame period, a data input pulse that has the pulse intensity Vdd1 and the pulse width T2 (T2<T1) is supplied during a second frame period, a data input pulse that has the pulse intensity Vdd2 (Vdd2<Vdd1) and the pulse width T3 (T3=T2) is supplied during a third frame period, and a data input pulse that has the pulse intensity Vdd2 (Vdd2<Vdd1) and the pulse width T4 (T4<T3) is supplied during a fourth frame period.

In this embodiment, when focusing on the pulse intensities, the pulse intensities are varied in time series from the pulse intensity Vdd1 to the pulse intensity Vdd2 weaker than the pulse intensity Vdd1 during the frame periods. Further, when focusing on the pulse widths, the pulse widths are decreased in time series according to the relation of T1>T2=T3>T4.

As such, if the pulse intensity and the pulse width are changed, the same effect as the first and second embodiments is obtained, and a variable range in a device and a driving method expands.

Fourth Embodiment

In a fourth embodiment, instead of a single pulse, a plurality of reset pulses are supplied to a common electrode during a reset period.

Figure 10:
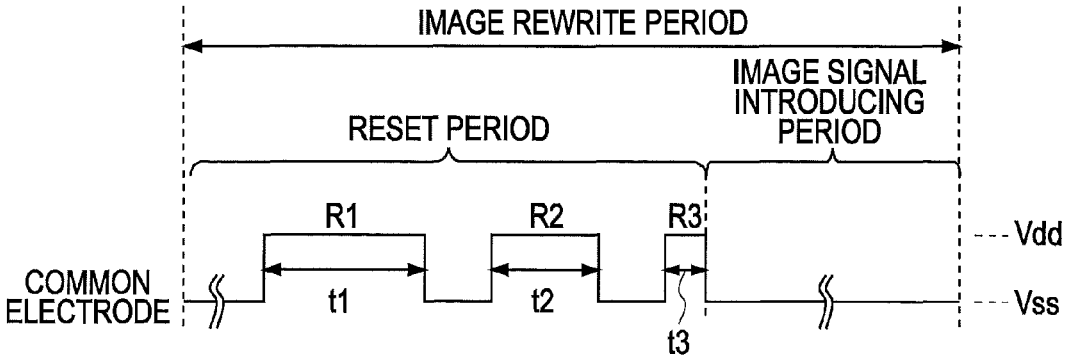
FIG. 10 is a signal waveform diagram illustrating the operation of one pixel during a reset period according to a fourth embodiment of the invention.

FIG. 10 is a waveform diagram illustrating the operation of one pixel during a reset period according to a fourth embodiment. As shown in FIG. 10, during a reset period, reset pulses R1, R2, and R3 are supplied such that pulse widths t1, t2, and t3 of the reset pulses R1, R2, and R3 are gradually decreased according to the relation of t1>t2>t3. As a result, at the time of white display during the reset period, the same effect as the first embodiment is obtained. In this case, the t1 indicates the minimum amount of time that is required to apply a voltage for moving the electrophoresis particles 36 and 37 between the electrodes (for example, from the pixel electrode 33 to the common electrode 34), when the voltage is constantly supplied.

Figure 11A:
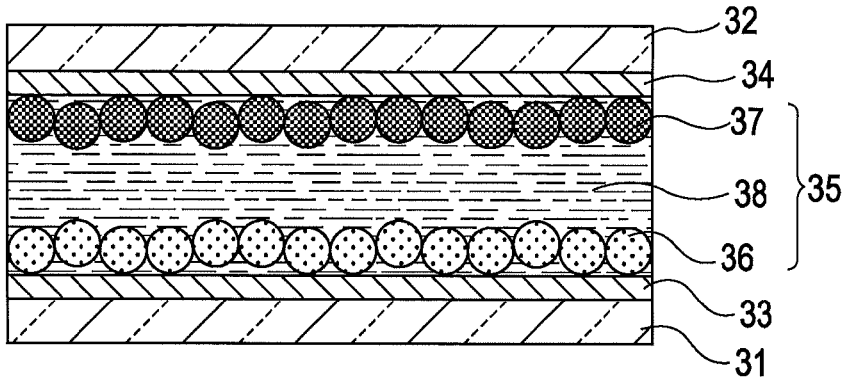
FIGS. 11A to 11C are diagrams illustrating the operation of electrophoresis particles in a case where a screen is reset from black display.
Figure 11B:
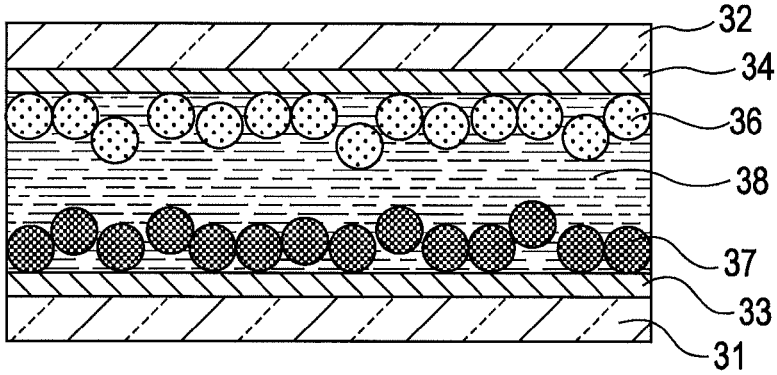
Figure 11C:
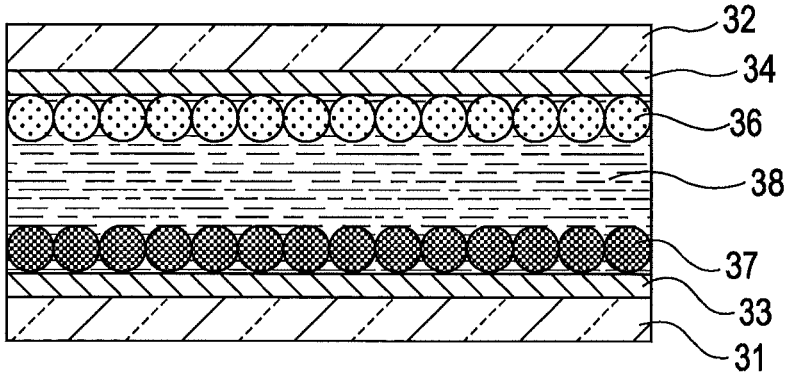

Next, in the case where the reset pulse is supplied to the dispersion system 35, the operation of the electrophoresis particles 36 and 37 will be described. FIGS. 11A to 11C are diagrams illustrating the operation of electrophoresis particles in a case where a screen is reset from black display. If a pulse R1 is applied to the common electrode 34, the electrophoresis particles 36 and 37 in the state shown in FIG. 11A start to move, and as shown in FIG. 11B, the black electrophoresis particles 37 move to almost the side of the pixel electrode 33, and the white electrophoresis particles 36 move to almost the side of the common electrode 34. However, as shown in FIG. 11B, there are particles that do not move to the predetermined locations for the period t1 or precipitate or float due to the convection of the dispersion medium 38 after the particles move to the predetermined locations. At this time, if the reset pulses R2 and R3, which have smaller pulse widths than the reset pulse R1, are applied, the electrophoresis particles 36 and 37 can move to the predetermined locations, as shown in FIG. 11C.

In this embodiment, during the reset period, white display is performed on an entire screen. During the image signal write period, the white electrophoresis particles move to the pixels performing black display and a write operation is performed. Since the pixels performing white display maintain a reset state, definition of the white display is determined by a distribution state of the white electrophoresis particles 36 that have moved at the time of the reset operation. Accordingly, during the reset period, a first reset pulse is applied so as to move the electrophoresis particles 36 and 37 to the substantial predetermined locations. Then, the reset pulses R2 and R3 are additionally applied, and thus it is possible to move almost all the electrophoresis particles 36 and 37 to the predetermined locations, thereby improving image quality of the white display.

Further, if the pulse widths are gradually decreased, image quality can be improved with the minimum power consumption, and the electrophoresis display element can be prevented from being deteriorated or damaged due to application of an excessive voltage.

Fifth Embodiment

In the fourth embodiment, the pulse width of the reset pulse is changed, while in a fifth embodiment, the pulse intensity of the reset pulse is changed.

Figure 12:
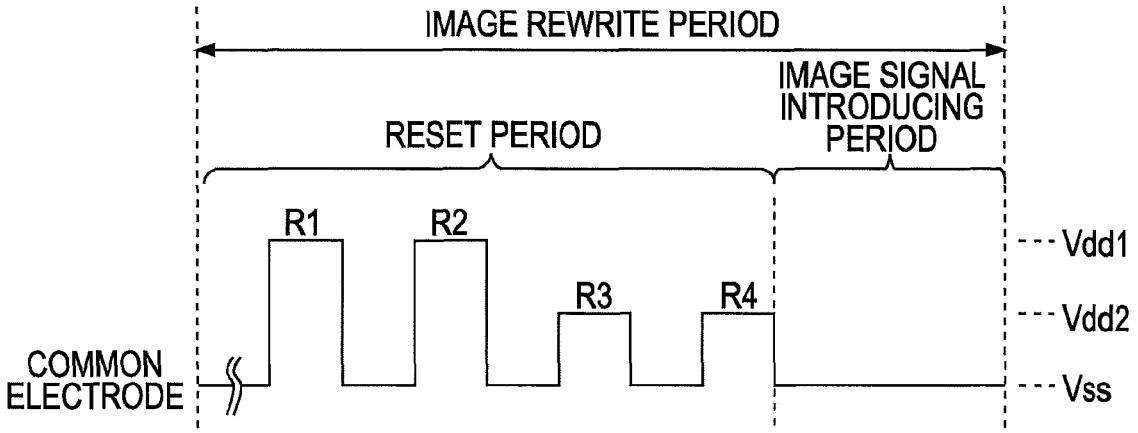
FIG. 12 is a signal waveform diagram illustrating the operation of one pixel during a reset period according to a fifth embodiment of the invention.

FIG. 12 is a waveform diagram illustrating the operation of one pixel during a reset period according to a fifth embodiment. As shown in FIG. 12, the pulse intensities of the reset pulses R1, R2, R3, and R4 are gradually decreased to the pulse intensities Vdd1, Vdd1, Vdd2, and Vdd2. As a result, it is possible to obtain the same effect as the fourth embodiment.

Sixth Embodiment

In the fourth embodiment, the pulse width of the reset pulse is changed, while in the fifth embodiment, the pulse intensity of the reset pulse is changed. However, the pulse width and the pulse intensity of the reset pulse may be changed.

Figure 13:
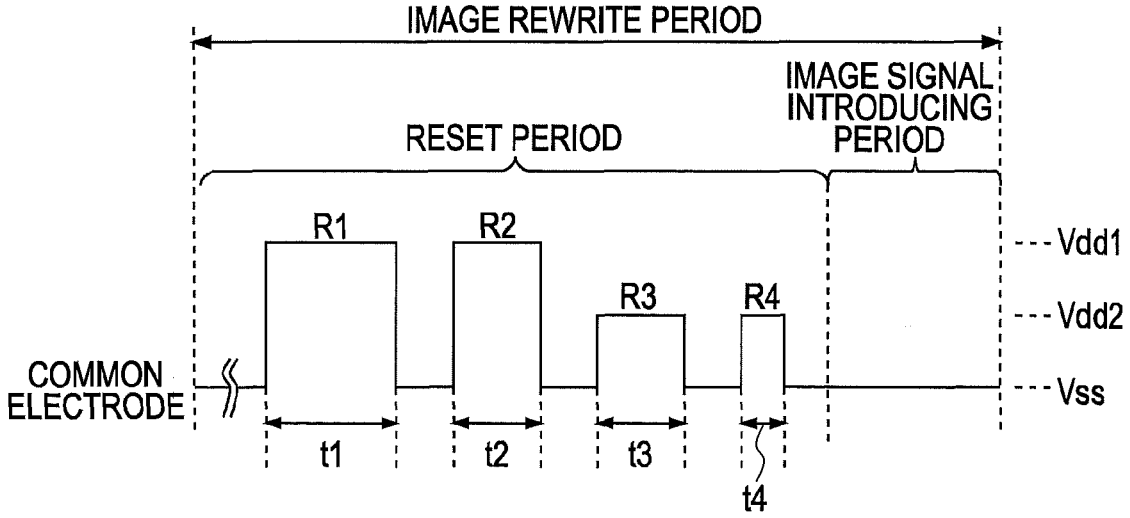
FIG. 13 is a signal waveform diagram illustrating the operation of one pixel during a reset period according to a sixth embodiment of the invention.

FIG. 13 is a waveform diagram illustrating the operation of one pixel during a reset period according to a sixth embodiment. As shown in FIG. 13, the pulse intensities of the reset pulses R1, R2, R3, and R4 are gradually decreased to the pulse intensities Vdd1, Vdd1, Vdd2, and Vdd2, and the pulse widths of the reset pulses R1, R2, R3, and R4 are gradually decreased to the pulse widths T1, T2, T3, and T4 (T1>T2=T3>T4).

Accordingly, the same effect as the fourth and fifth embodiments can be obtained, and a design range in a device and a driving method expands.

Seventh Embodiment

Next, examples of an electronic apparatus that includes the above-described electrophoresis display device 1 will be described. The electrophoresis display device 1 according to this embodiment can be applied to various electronic apparatuses.

Figure 14A:
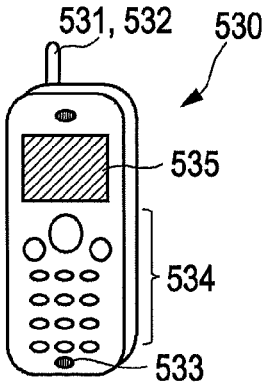
FIGS. 14A to 14*c* are perspective views schematically illustrating examples of an electronic apparatus.
Figure 14B:
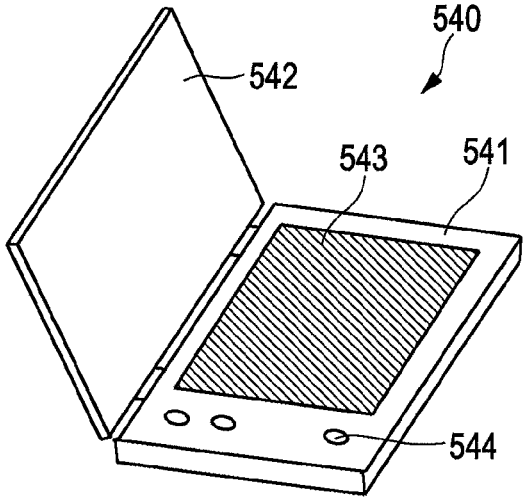
Figure 14C:
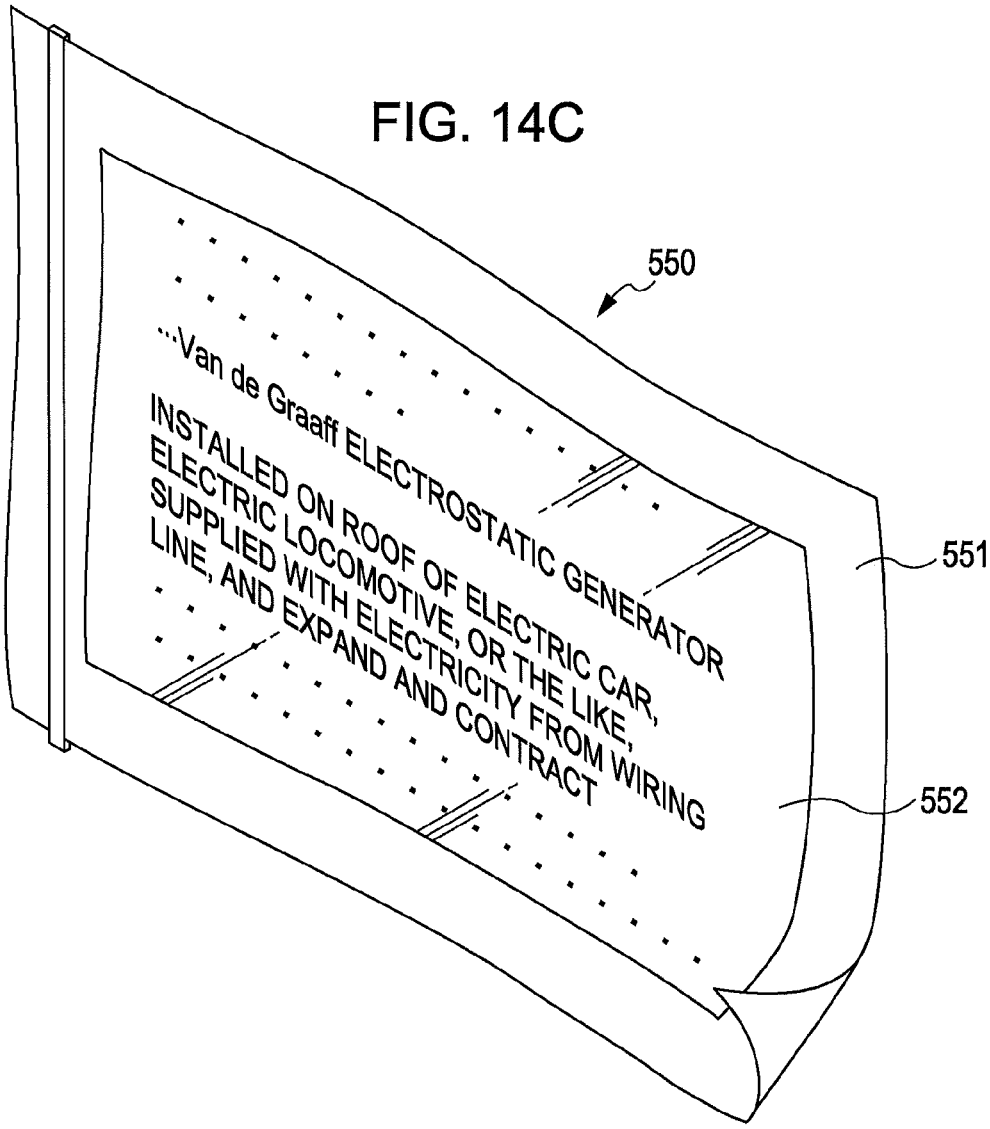

FIGS. 14A to 14C are perspective views schematically illustrating examples of an electronic apparatus. FIG. 14A is a diagram illustrating a case where the electrophoresis display device is applied to a cellular phone. A cellular phone 530 shown in FIG. 14A includes an antenna unit 531, a sound output unit 532, a sound input unit 533, an operation unit 534, and a display unit 535. In this example, the display unit 535 is composed of the electrophoresis display deice 1.

FIG. 14B is a diagram illustrating a case where the electrophoresis display device is applied to an electronic book. An electronic book 540 shown in FIG. 14B includes a book-like frame 541, and a cover 542 that is provided to freely rotate (open and close) with respect to the frame 541. The frame 541 includes a display device 543 that has a display surface of an exposed state, and an operation unit 544. In this example, the display device 543 is composed of the electrophoresis display device 1.

FIG. 14C is a diagram illustrating a case where the electrophoresis display device is applied to an electronic paper. An electronic paper 550 shown in FIG. 14C includes a main body 551 that is composed of a rewritable sheet having the same texture and flexibility as paper, and a display unit 552.

In this electronic paper 550, the display unit 552 is composed of the above-described electrophoresis display device 1.

The electrophoresis display device according to the embodiment of the invention can be applied to various apparatuses, in addition to the above-described electronic apparatuses. Examples of the electronic apparatus include a facsimile having a display function, a digital camera (finder unit), a video tape recorder having a display function, a car navigation device, an electronic note, an electronic calculator, an electronic newspaper, an electric bulletin board, a display television for propaganda or advertisement, a television, a word processor, a personal computer, a phone, a POS terminal, an apparatus having a touch panel, or the like.

In addition, it should be understood that the invention is not limited to the contents of the above-described embodiments, but various modifications and changes may be made thereto within the scope of the subject matter of the invention.

For example, in the above-described embodiments, when the controller 11 performs a control operation, the controller 11 instructs the scanning line driving circuit 13 and the data line driving circuit 14 using a control signal not shown in FIG. 1 on whether the operation according to the embodiment of the invention is performed. Then, the scanning line driving circuit 13 and the data line driving circuit 14 that have received the instruction select a clock or a voltage level necessary for the operation and drive a data input pulse having the required pulse width and pulse intensity.

For example, in the above-described embodiment, during the reset period, white display is performed on an entire screen. In addition, during the image signal write period, the white electrophoresis particles move to pixels performing black display, and a write operation is performed. However, the invention is not limited thereto. During the reset period, black display is performed on the entire screen, and during the image signal write period, a write operation may be performed by using the white electrophoresis particles. This can be achieved by the same driving method by charging the white and black electrophoresis particles with opposite polarities (the white electrophoresis particle is charged with a positive polarity and the black electrophoresis particle is charged with a negative polarity).

Furthermore, in the above-described embodiments, image display has been performed by using electrophoresis particles of two colors, but the invention is not limited thereto. For example, the dispersion medium is colored (for example, colored with a white color), and electrophoresis particles, which has a color (for example, black color) different from the color of the dispersion medium, move between electrodes, thereby displaying an image.

Further, since an image (still image) can be gradually formed by repeating a write operation, it is possible to obtain effects of an entire screen being gradually varied, such as fade-in and fade-out.

What is claimed is:

1. An electrophoresis display device comprising:

electrophoresis display elements, corresponding to pixels of a display unit, each having a structure where a dispersion medium containing electrophoresis particles is interposed between a common electrode and a pixel electrode;

a driving unit that applies a voltage between the common electrode and the pixel electrodes and drives the electrophoresis display elements; and a control unit that controls the driving unit, an image rewrite period, during which a rewrite display operation is performed on the electrophoresis display elements, including a reset period and an image signal introducing period, during the image signal introducing period, the electrophoresis display elements being driven with a first data input pulse and a second data input pulse, the first data input pulse and the second data input pulse being consecutive and uninterrupted by a reset pulse, a first frame period being defined as a period during which a data write operation is performed once on all the pixels of the display unit, and the first data input pulse being driven during less than an entirety of the first frame period.

2. The electrophoresis display device according to claim 1, the image signal introducing period including a plurality of frame period, and the first data input pulse being used during the first frame period that is an initial frame period among the plurality of frame periods, and the second data input pulse being used during frame periods other than the first frame period, a pulse width of the second data input pulse being equal to or smaller than a pulse width of the first data input pulse, and the pulse intensity of the second data input pulse is equal to or weaker than the pulse intensity of the first data input pulse.

3. The electrophoresis display device according to claim 2, a total sum of pulse widths of data input pulses applied to each pixel during a portion of the plurality of frame periods being the minimum amount of application time that is required to move the electrophoresis particles to predetermined locations so as to display a predetermined image.

4. The electrophoresis display device according to claim 1, a pulse width of the first data input pulse being the minimum amount of application time required to move the electrophoresis particles to predetermined locations so as to display a predetermined image.

5. The electrophoresis display device according to claim 1, when it is assumed that n is a natural number, a pulse width of the second data input pulse during a (n+1)-th frame period being equal to or smaller than a pulse width of the second data input pulse during an n-th frame period.

6. The electrophoresis display device according to claim 1, when it is assumed that n is a natural number, the pulse intensity of the second data input pulse during a (n+1)-th frame period being equal to or weaker than the pulse intensity of the second data input pulse during an n-th frame period.

7. The electrophoresis display device according to claim 1, during the reset period, a plurality of reset pulses are applied to the common electrode, and a pulse width of at least one reset pulse among the plurality of reset pulses being different from a pulse width of a first reset pulse.

8. The electrophoresis display device according to claim 7, pulse widths of the reset pulses being gradually decreased.

9. The electrophoresis display device according to claim 1, during the reset period, a plurality of reset pulses being applied to the common electrode, and the pulse intensity of at least one reset pulse among the plurality of reset pulses being different from the pulse intensity of a first reset pulse.

10. The electrophoresis display device according to claim 9, pulse intensities of the reset pulses being gradually decreased.

11. An electrophoresis display device comprising:

electrophoresis display elements, corresponding to pixels of a display unit, each having a structure where a dispersion medium containing electrophoresis particles is interposed between a common electrode and a pixel electrode;

a driving unit that applies a voltage between the common electrode and the pixel electrodes and drives the electrophoresis display elements; and a control unit that controls the driving unit, an image rewrite period, during which the control unit controls the driving unit so as to allow the driving unit to apply a voltage for performing an image rewrite operation between the common electrode and the pixel electrodes, including a reset period and an image signal introducing period that is set after the reset period, and the image signal introducing period including a plurality of frame periods during which signals constituting a display image are supplied, and at least one different frame period during which a second data input pulse, which having a pulse width and/or a pulse intensity different from a pulse width and a pulse intensity of a first data input pulse during a first frame period, being applied to the electrophoresis display elements, the first data input pulse and the second data input pulse being uninterrupted by a reset pulse, the first frame period being defined as a period during which a data write operation is performed once on all the pixels of the display unit, and the first data input pulse being driven during less than an entirety of the first frame period.

12. An electronic apparatus comprising the electrophoresis display device according to claim 1.

13. A method of driving an electrophoresis display device that includes electrophoresis display elements, corresponding to pixels of a display unit, each having a structure where a dispersion medium containing electrophoresis particles is interposed between a common electrode and a pixel electrode, the method comprising:

applying a reset voltage to the electrophoresis display elements, moving the electrophoresis particles in the dispersion medium to predetermined locations, and erasing an image on a display screen to perform a reset operation; and supplying a plurality of data input pulses to each of selected pixels after the reset operation, at least one data input pulse among the plurality of data input pulses having a pulse width and/or a pulse intensity different from a pulse width and a pulse intensity of a first data input pulse, the first data input pulse and the at least one data input pulse being uninterrupted by a reset pulse, a first frame period being defined as a period during which a data write operation is performed once on all the pixels of the display unit, and the first data input pulse being driven during less than an entirety of the first frame period.

14. The method of driving an electrophoresis display device according to claim 13, pulse widths of the data input pulses being gradually decreased.

15. The method of driving an electrophoresis display device according to claim 13, pulse intensities of the data input pulses being gradually decreased.

16. The method of driving an electrophoresis display device according to claim 13, the reset voltage being applied a plurality of times, and a pulse width of at least one reset pulse is different from a pulse width of a first reset pulse.

17. The method of driving an electrophoresis display device according to claim 16, pulse widths of the reset pulses being gradually decreased.

18. The method of driving an electrophoresis display device according to claim 13, the reset voltage being applied a plurality of times, and the pulse intensity of at least one reset pulse being different from the pulse intensity of a first reset pulse.

19. The method of driving an electrophoresis display device according to claim 18, pulse intensities of the reset pulses being gradually decreased.

20. An electrophoresis display device comprising:

electrophoresis display elements, corresponding to pixels of a display unit, each having a structure where a dispersion medium containing electrophoresis particles is interposed between a common electrode and a pixel electrode;

a driving unit that applies a voltage between the common electrode and the pixel electrodes and drives the electrophoresis display elements; and a control unit that controls the driving unit, an image rewrite period, during which the control unit controls the driving unit so as to allow the driving unit to apply a voltage for performing an image rewrite operation between the common electrode and the pixel electrodes, including a reset period and an image signal introducing period that being set after the reset period, and during the reset period and/or the image signal introducing period, a predetermined voltage pulse being applied to selected pixels from among the pixels so as to move the electrophoresis particles to substantially predetermined locations, and at least one additional voltage pulse, which having a pulse width and/or a pulse intensity different from a pulse width and a pulse intensity of the predetermined voltage pulse, is continuously applied to the selected pixels, such that locations of the electrophoresis particles being minutely adjusted, the predetermined voltage pulse and the additional voltage pulse being uninterrupted by a reset pulse, a first frame period being defined as a period during which a data write operation is performed once on all the pixels of the display unit, and the predetermined voltage pulse being driven during less than an entirety of the first frame period.

* * * * *